US007594488B2

(12) United States Patent
Yoshijima et al.

(10) Patent No.: US 7,594,488 B2
(45) Date of Patent: Sep. 29, 2009

(54) CYLINDER HEAD COVER AND METHOD FOR MOUNTING CYLINDER HEAD COVER TO CYLINDER HEAD

(75) Inventors: Kazuya Yoshijima, Okazaki (JP); Naohiro Hasegawa, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 605 days.

(21) Appl. No.: 11/287,316

(22) Filed: Nov. 28, 2005

(65) Prior Publication Data

US 2006/0112916 A1 Jun. 1, 2006

(30) Foreign Application Priority Data

Nov. 30, 2004 (JP) ..... 2004-347476

(51) Int. Cl.
*F01M 9/10* (2006.01)

(52) U.S. Cl. ..... 123/90.38; 123/90.12; 123/90.15; 123/90.34; 123/193.5

(58) Field of Classification Search ..... 123/90.12, 123/90.13, 90.33, 90.38, 90.15, 90.16, 90.17, 123/90.18, 90.34, 193.3, 193.5
See application file for complete search history.

(56) References Cited

U.S. PATENT DOCUMENTS

| | | | | |
|---|---|---|---|---|
| 5,771,850 | A * | 6/1998 | Okada | 123/143 C |
| 5,799,631 | A | 9/1998 | Nakamura | |
| 6,684,836 | B2 * | 2/2004 | Inoue | 123/90.17 |
| 7,121,243 | B2 | 10/2006 | Yoshijima et al. | |
| 7,162,986 | B2 * | 1/2007 | Yoshijima et al. | 123/90.38 |
| 7,174,868 | B2 * | 2/2007 | Yoshijima et al. | 123/90.38 |
| 7,341,033 | B2 * | 3/2008 | Yoshijima et al. | 123/90.38 |
| 2006/0000434 | A1 | 1/2006 | Yoshijima et al. | |
| 2006/0011158 | A1 | 1/2006 | Yoshijima et al. | |
| 2006/0027199 | A1 | 2/2006 | Yoshijima et al. | |
| 2006/0112922 | A1 | 6/2006 | Yoshijima et al. | |

FOREIGN PATENT DOCUMENTS

| | | | |
|---|---|---|---|
| DE | 197 45 234 | C2 | 4/1998 |
| DE | 10 2005 031 400 | A1 | 2/2006 |
| JP | U-63-160472 | | 10/1988 |
| JP | U-63-1604712 | | 10/1988 |
| JP | U-06-004311 | | 1/1994 |
| JP | 11132016 | A * | 5/1999 |
| JP | A-11-132016 | | 5/1999 |
| JP | A 11-210425 | | 8/1999 |
| JP | A 2003-227321 | | 8/2003 |
| JP | A 2003-232260 | | 8/2003 |
| JP | B2 3525709 | | 2/2004 |
| JP | A 2004-232615 | | 8/2004 |

* cited by examiner

*Primary Examiner*—Ching Chang
(74) *Attorney, Agent, or Firm*—Oliff & Berridge, PLC

(57) ABSTRACT

A cylinder head cover covers a cylinder head of an internal combustion engine. The engine has a variable valve actuation mechanism and a control valve for controlling supply and drainage of hydraulic oil to and from the variable valve actuation mechanism. The cylinder head cover includes a cover main body fixed to the cylinder head and a valve case to which the control valve is attached. The valve case is caused to contact a side of the cover main body that corresponds to the cylinder head. Therefore, the cylinder head cover maintains a firm attachment of the valve case to the cylinder head.

12 Claims, 4 Drawing Sheets

CYLINDER HEAD COVER AND METHOD FOR MOUNTING CYLINDER HEAD COVER TO CYLINDER HEAD

BACKGROUND OF THE INVENTION

The present invention relates to a cylinder head cover fixed to a cylinder head of an internal combustion engine. The present invention further relates to a method for mounting a cylinder head cover to a cylinder head.

Conventionally, internal combustion engines are known in which an oil control valve for controlling supply and drainage of hydraulic oil to and from a variable valve actuation mechanism is attached to a cylinder head cover (for example, refer to Japanese Patent No. 3525709).

Typically, such a cylinder cover is formed to have relatively thin walls to reduce the weight. This reduces the rigidity of the cylinder head cover compared to that of the cylinder head. Therefore, when such a cylinder head cover is fixed to a cylinder head, the cover could be deformed. Such deformation can deform a portion of the cover to which an oil control valve is attached. As a result, supply and drainage control performed by the valve is likely to be adversely affected.

Accordingly, in the configuration disclosed in the document, the cylinder head cover includes a main body fixed to a cylinder head and a valve case that is formed separately from the main body and receives an oil control valve. In this configuration, deformation of the cover is hardly transmitted to the portion of the valve case to which the valve is attached. Thus, the attaching portion is hardly deformed.

In the configuration disclosed in the above patent, a flange is formed on a surface (contacting surface) of the valve case that contacts the cylinder head cover. The valve case is placed on the cylinder head cover main body with the flange contacting an upper surface (outer surface) of the cylinder head cover main body. The valve case is then fixed to the cylinder head cover main body with bolts. Further, in the above-described configuration, a variable valve actuation mechanism is provided in the cylinder head. An oil passage for supplying and draining hydraulic oil to and from the variable valve actuation mechanism extends through both of the cylinder head and the oil control valve. The passage thus has a separated structure, that is, the passage has a section formed in the valve case and a section formed in the cylinder head. In other words, the oil passage having separate sections has a joint.

When securing the cylinder head cover main body to attach the valve case to the cylinder head, an upper surface of the cylinder head in which an opening of the oil passage is formed is pressed downward by a lower surface of the valve case. This guarantees the sealing performance at the joint in the oil passage and facilitates the assembly.

However, when the valve case is attached so that the pressing occurs, the reaction force applied to the valve case from the cylinder head acts as external force (separating force) that pushes the valve case away from the upper surface of the cylinder head cover. The separating force acts to degrade the attachment of the valve case to the cylinder head cover. Further, such separating force is likely to a produce local reaction force in the valve case and the cylinder head cover main body, which can deform the valve case and the cylinder head cover main body. As a result, the portion of the valve case to which the oil control valve is attached is likely to be deformed.

Since the rigidity of the cylinder head cover main body is likely to be reduced as described above, vibrations transmitted from the engine to the cylinder head cover main body can further degrade the state of attachment.

SUMMARY OF THE INVENTION

Accordingly, it is an objective of the present invention to provide a cylinder head cover that maintains a firm attachment of a valve case to a cylinder head. Another objective of the present invention is to provide an improved method for mounting a cylinder head cover to a cylinder head.

To achieve the above-mentioned objective, the present invention provides a cylinder head cover for covering a cylinder head of an internal combustion engine. The engine has a variable valve actuation mechanism and a control valve for controlling supply and drainage of hydraulic oil to and from the variable valve actuation mechanism. The cylinder head cover includes a cover main body fixed to the cylinder head; and a valve case to which the control valve is attached. The valve case is caused to contact a side of the cover main body that corresponds to the cylinder head.

Further, the present invention provides a method for mounting a cylinder head cover to a cylinder head. The cylinder head cover covers the cylinder head of an internal combustion engine having a variable valve actuation mechanism. The cylinder head cover has a cover main body having a through hole and a valve case. The valve case has a valve attaching portion and a held portion. The method includes inserting the valve attaching portion into the through hole; fixing the cover main body to the cylinder head such that the held portion is held between the cover main body and the cylinder head; and attaching a control valve to the valve attaching portion. The control valve controls supply and drainage of hydraulic oil to and from the variable valve actuation mechanism.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
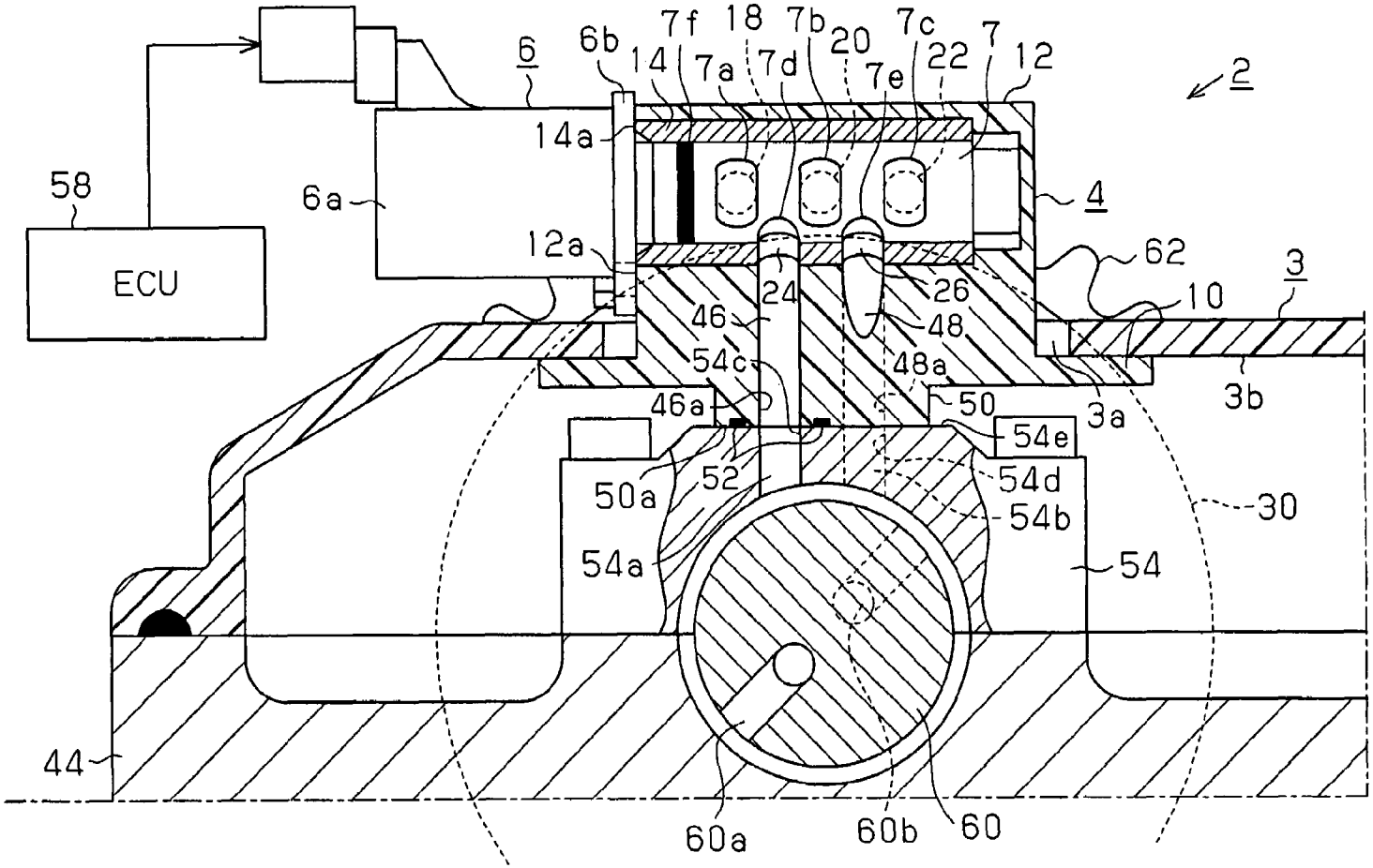
FIG. 1 is a cross-sectional view illustrating a part of a cylinder head cover according to one embodiment of the present invention and its surroundings.
Figure 2:
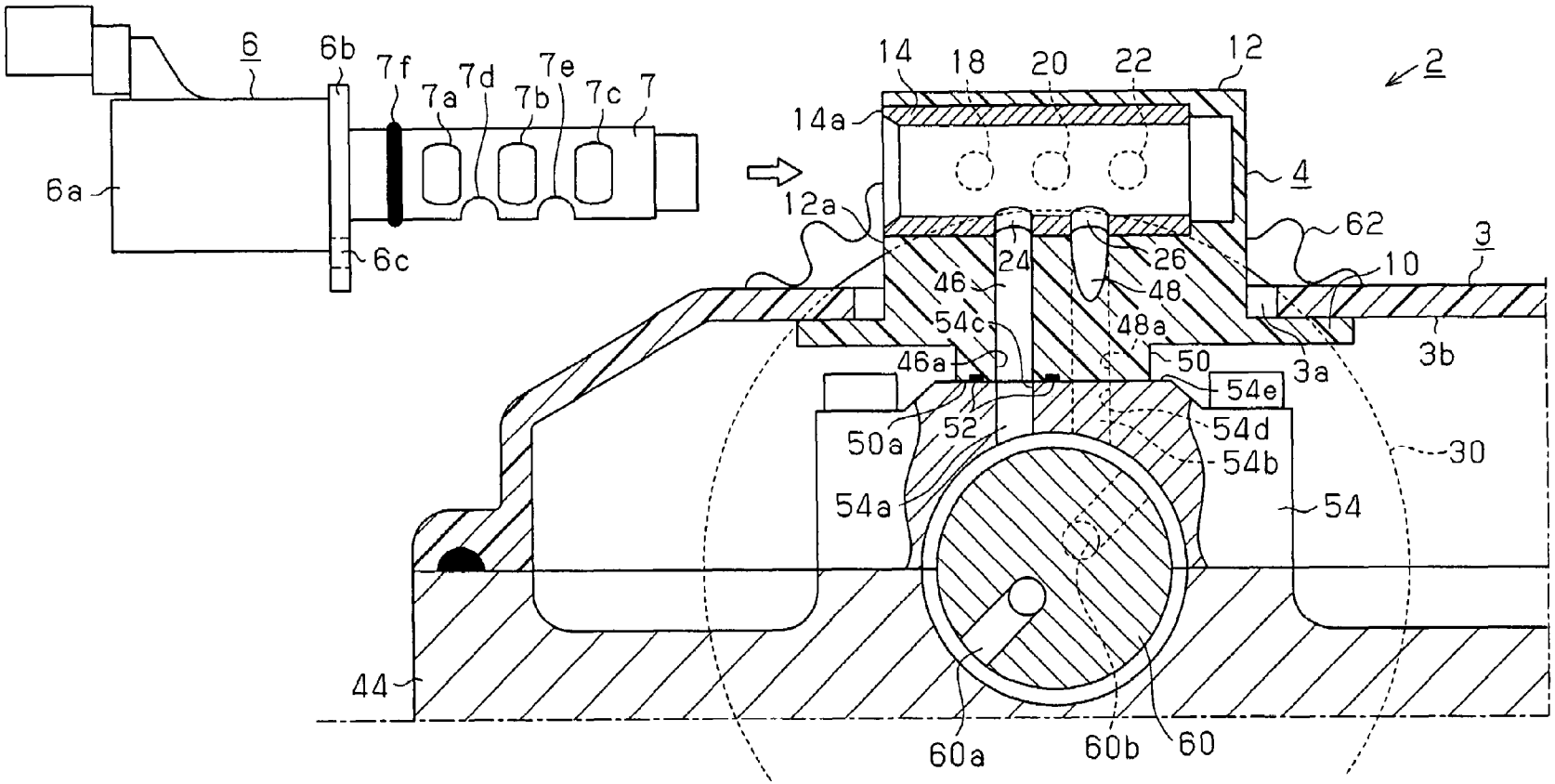
FIG. 2 is a cross-sectional view illustrating an OCV before installation, a part of the cylinder head cover according to the embodiment of FIG. 1, and its surroundings.

FIG. 1 is a cross-sectional view illustrating a part of a cylinder head cover 2 according to a preferred embodiment of the present invention. Specifically, FIG. 1 illustrates a state where a valve case 4 is fitted and fixed to a resin main body 3 of the cylinder head cover 2. FIG. 2 is a cross-sectional view illustrating the cylinder head cover 2 in a state where an oil control valve (hereinafter, referred to as OCV) 6 is about to be attached to the cylinder head cover 2. In the following, a direction toward the top side of each of FIGS. 1 and 2 is defined as upward direction, and a direction toward the bottom side is defined as downward direction.

Figure 3A:
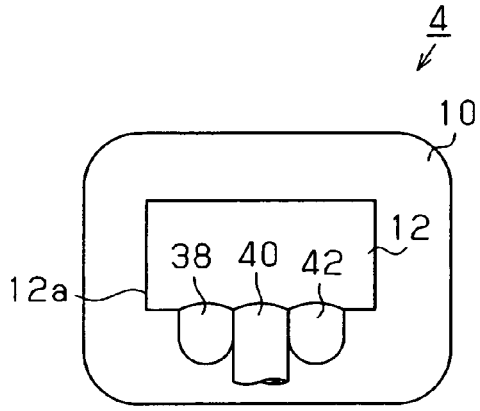
FIG. 3A is a top plan view illustrating a valve case according to the embodiment of FIG. 1.
Figure 3D:
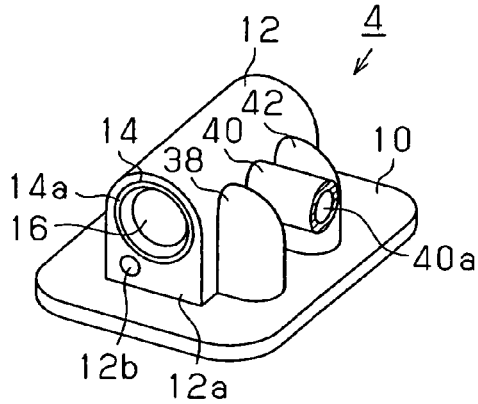
FIG. 3D is a perspective view illustrating the valve case of FIG. 3A.
Figure 3B:
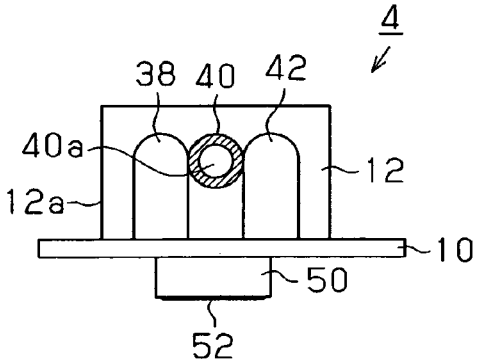
FIG. 3B is a front view illustrating the valve case of FIG. 3A.
Figure 3E:
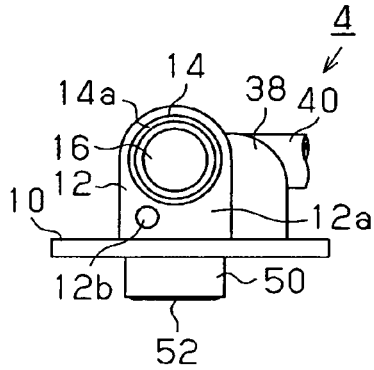
FIG. 3E is a left side view illustrating the valve case of FIG. 3A.

The valve case 4 is integrally molded with resin into a shape as shown in FIGS. 3A to 8F. FIG. 3A is a plan view, FIG. 3B is a front view, FIG. 3C is a bottom view, FIG. 3D is a perspective view, FIG. 3E is a left side view, and FIG. 3F is a right side view.

The valve case 4 includes a contacting portion 10 that functions as a flange. An attaching portion 12 formed into a substantially cylindrical shape with resin is located on the upper surface of the contacting portion 10. A sleeve (reinforcing member) 14 is embedded in the resin that forms the attaching portion 12 with an OCV insertion end 14*a* open to the outside. Specifically, when integrally molding the valve case 4 with resin, the sleeve 14 is embedded in the valve case 4 by insert molding.

The sleeve 14 is cylindrical as shown in FIGS. 4A to 4E and is formed of material that has a rigidity higher than that of the resin of the valve case 4 and has the same coefficient of thermal expansion as a spool housing 7 of the OCV 6 shown in FIGS. 1 and 2. More specifically, the sleeve 14 is formed of aluminum base alloy. The sleeve 14 may also be formed of metal material that is exactly the same as that of the spool housing 7 of the OCV 6.

The sleeve 14 includes oil holes 18, 20, 22, 24, 26, which are formed at positions corresponding to five ports 7*a*, 7*b*, 7*c*, 7*d*, 7*e* formed on the spool housing 7 of the OCV 6. The oil holes 18, 20, 22, 24, 26 extend from an mounting bore 16 formed inside the sleeve 14 to the outer circumferential surface of the sleeve 14. A tapered surface 28 is formed at the OCV insertion end 14*a* of the sleeve 14 to facilitate insertion of the OCV 6. In FIGS. 1 and 2, the oil holes 18, 20, 22 are shown by broken lines on the sleeve 14 since the oil holes 18, 20, 22 are located in a part that has been cut away as viewed in the drawings.

Primer is applied to an outer circumferential surface 14*b* of the sleeve 14 before insert molding. Thus, when covered with resin during insert molding, the primer is strongly bonded to the resin due to its adhesivity. Therefore, the sleeve 14 is strongly bonded with the resin of the attaching portion 12 of the valve case 4 formed by insert molding. During the insert molding, slide pins are arranged in the mold to be continuous with the oil holes 18 to 26 formed in the sleeve 14. In this manner, oil passages that are connected to the oil holes 18 to 26 are also formed in the valve case 4.

As the above mentioned oil passages, three oil passage portions 38, 40, 42 having oil passages 38*a*, 40*a*, 42*a* are formed on the outer circumferential portion of the attaching portion 12. The oil passages 38*a*, 40*a*, 42*a* are connected to the three oil holes 18, 20, 22 of the sleeve 14. The middle oil passage portion 40, which is a supplying oil passage portion, has the oil passage 40*a*, which is a supplying oil passage, is connected to a hydraulic oil supplying path of a cylinder head 44 through a pipe and other oil passages. Thus, hydraulic oil is supplied to the OCV 6 inside the sleeve 14. The oil passage portions 38, 42, which are draining oil passage portions located on both sides of the middle oil passage portion 40, include the oil passages 38*a*, 42*a*, which are draining oil passages. Hydraulic oil is thus directly drained from the OCV 6 to the interior of the resin cylinder head cover 2.

Furthermore, among the above mentioned oil passages of the valve case 4, intermediate passages 46, 48 are connected to the oil holes 24, 26 of the sleeve 14. The intermediate passages 46, 48 are formed in an oil passage coupling portion 50. The intermediate passages 46, 48 permit hydraulic oil to be supplied and drained to and from the OCV 6 and a variable valve actuation mechanism 30 (see FIGS. 1 and 2). An O-ring 52 is located below a lower surface 50*a* of the oil passage coupling portion 50 about openings 46*a*, 48*a* of the intermediate passages 46, 48. The O-ring 52 functions as a sealing member when the oil passage coupling portion 50 abuts against an upper surface 54*e* of one of cam caps 54. In this embodiment, an opening 3*a*, which is a through hole formed on the cylinder head cover main body 3, is directly above the cam caps 54 that is closest to the variable valve actuation mechanism 30.

A bolt screw-in hole 12*b* is formed in an OCV insertion end 12*a* of the attaching portion 12. As shown in FIG. 1, when the spool housing 7 of the OCV 6 is accommodated in the mounting bore 16 of the sleeve 14, a bolt hole 6*c* of a bracket 6*b* provided on the OCV 6 is located in front of the bolt screw-in hole 12*b*. Thus, the OCV 6 is fastened to the valve case 4 by fastening a bolt through the bolt hole 6*c*.

The valve case 4 configured as described above is formed by first arranging the sleeve 14 in a mold for injection molding and then integrally molding the contacting portion 10, the attaching portion 12, and the oil passage coupling portion 50 with resin.

The valve case 4 formed in this manner is fixed to the cylinder head cover 2 by inserting the attaching portion 12 into the opening 3*a* of the cylinder head cover main body 3 from below, and welding the contacting portion 10 to a lower surface 3*b* of the resin main body 3 about the opening 3*a* (see FIGS. 1 and 2). As a result, the opening 3*a* of the resin cylinder head cover main body 3 is completely closed.

Figure 3C:
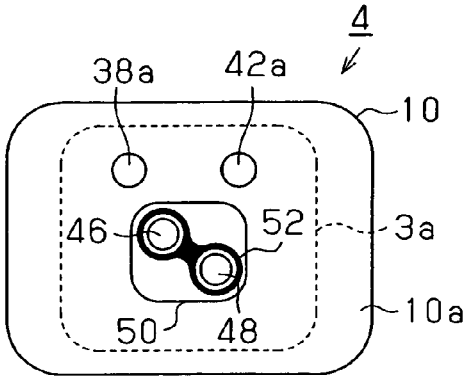
FIG. 3C is a bottom view illustrating the valve case of FIG. 3A.
Figure 3F:
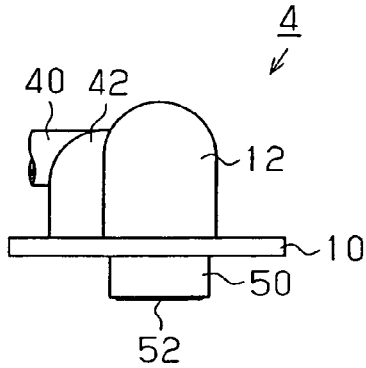
FIG. 3F is a right side view illustrating the valve case of FIG. 3A.
Figure 4A:
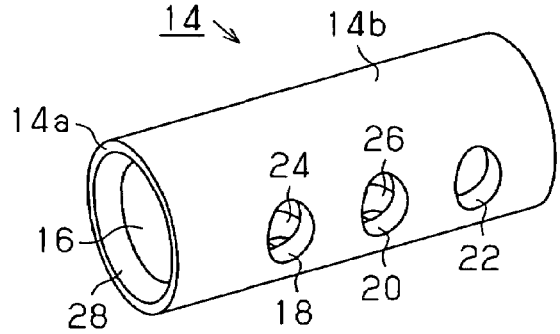
FIG. 4A is a perspective view illustrating a sleeve according to the embodiment of FIG. 1.
Figure 4B:
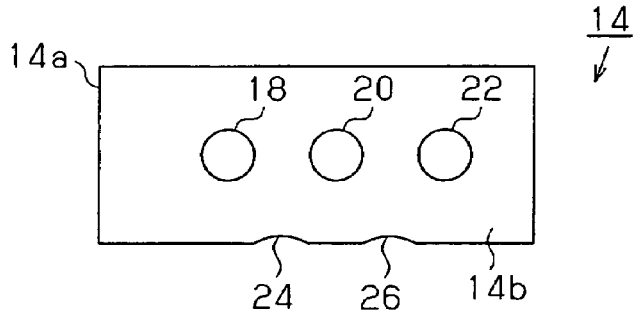
FIG. 4B is a front view illustrating the sleeve of FIG. 4A.
Figure 4C:
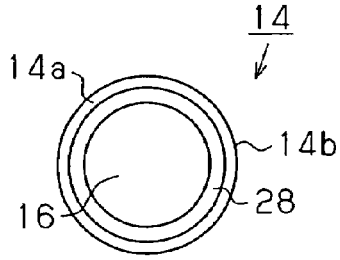
FIG. 4C is a left side view illustrating the sleeve of FIG. 4A.
Figure 4D:
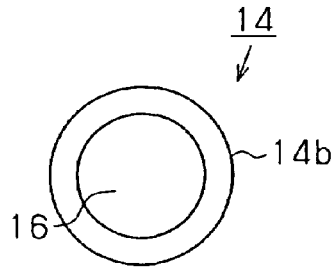
FIG. 4D is a right side view illustrating the sleeve of FIG. 4A.
Figure 4E:
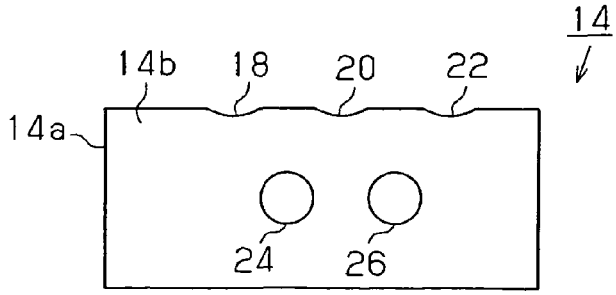
FIG. 4E is a bottom view illustrating the sleeve of FIG. 4A.

A broken line in FIG. 3C represents the arrangement of the opening 3*a* of the resin cylinder head cover main body 3 with respect to the contacting portion 10 of the valve case 4 when the contacting portion 10 is welded to the resin cylinder head cover main body 3. The contacting portion 10 is welded at the entire circumference of the opening 3*a* in an area 10*a* of the contacting portion 10 where the resin cylinder head cover main body 3 and the contacting portion 10 overlap each other. Therefore, the draining oil passages 38*a*, 42*a* drain hydraulic oil to the inside of the cylinder head cover 2. The supplying oil passage 40*a* in the middle oil passage portion 40 is connected to another supplying passage (not shown), thereby permitting hydraulic oil to be supplied to the OCV 6.

The opening 3*a* of the resin cylinder head cover main body 3 is directly above one of the cam caps 54 that is closest to the variable valve actuation mechanism 30, when the cylinder head cover 2 is attached to the cylinder head 44. Thus, when the cylinder head cover 2 is located on the cylinder head 44 as shown in FIG. 2 and fastened to the cylinder head 44 with a bolt, the intermediate passages 46, 48 of the oil passage coupling portion 50 are connected to cam cap passages 54*a*, 54*b* of the cam cap 54, respectively. With the valve case 4 inserted into the opening 3*a*, the contacting portion 10 and the passage coupling portion 50 are held between the cylinder head 44 and the cover main body 3.

Pressing force produced by fastening the bolt at the lower surface 50*a* of the passage coupling portion 50 and the upper surface 54*e* of the cam cap 54 increases the sealing between the surfaces 50*a*, 54*e*. Also, upward reaction force acting on the valve case 4 due to the pressing acts in a direction increasing the adherence of the contacting portion 10 to the lower surface 3*b* of the resin cylinder head cover main body 3.

The spool housing 7 of the OCV 6 is inserted in the cylinder head cover 2 configured as described above from the OCV insertion end 14*a* of the sleeve 14 to the inside of the mounting bore 16 as shown in FIG. 2. The mounting bore 16 of the sleeve 14 is formed with high precision such that the clearance between the spool housing 7 and the sleeve 14 is constant. Since the sleeve 14 is formed of metal material that has rigidity sufficiently higher than the resin that forms the attaching portion 12, the dimensional accuracy of the mounting bore 16 is sufficiently maintained despite of deformation of the resin after the insert molding, deformation of the resin caused by fastening the cylinder head cover 2 to the cylinder head 44 by bolts, and subsequent thermal deformation.

Therefore, the spool housing 7 is easily inserted into a predetermined position in the mounting bore 16, and the OCV 6 is attached to the attaching portion 12 in a suitable manner as shown in FIG. 1. An O-ring 7*f* is arranged at the proximal portion of the spool housing 7 to prevent hydraulic oil that slightly leaks from the clearance between the spool housing 7 and the sleeve 14 from being drained to the outside of the cylinder head cover 2. The bracket 6*b* is then fastened with a bolt and the attachment of the OCV 6 is completed.

The OCV 6 is mounted as described above and an electronic control unit (ECU) 58 controls exciting current to an electromagnetic solenoid section 6*a* of the OCV 6 in accordance with the operating state of the engine. Accordingly, the hydraulic oil supplied to the port 7*b* of the spool housing 7 from the supplying oil passage 40*a* is supplied to one of the oil holes 24, 26 and drained from the other one of the oil holes 24, 26. In this manner, the hydraulic oil is supplied to and drained from the variable valve actuation mechanism 30 using the intermediate passages 46, 48, the cam cap passages 54*a*, 54*b*, and two oil passages 60*a*, 60*b* located in a camshaft 60. For example, the-variable valve actuation mechanism 30 is actuated to retard the valve timing when the hydraulic oil is supplied to the variable valve actuation mechanism 30 through one of the paths, that is, through the intermediate passage 48, the cam cap passage 54*b*, and the oil passage 60*b*, and the hydraulic oil is drained via the other path, that is, the intermediate passage 46, the cam cap passage 54*a*, and the oil passage 60*a*. Thus, the rotational phase of the camshaft 60 with respect to a timing sprocket 62 is retarded, thereby retarding the valve timing.

Contrastingly, the variable valve actuation mechanism 30 is actuated to advance the timing when the hydraulic oil is supplied to the variable valve actuation mechanism 30 through the intermediate passage 46, the cam cap passage 54*a*, and the oil passage 60*a*, and is drained through the intermediate passage 48, the cam cap passage 54*b*, and the oil passage 60*b*. Thus, the rotational phase of the camshaft 60 with respect to the timing sprocket 62 is advanced, thereby advancing the valve timing.

The present invention has the following advantages.

(1) According to the present embodiment, the contacting portion 10 of the valve case 4 contacts the lower surface 3*b* of the resin cylinder head cover main body 3. That is, the valve case 4 is caused to contact lower surface 3*b*, i.e., a side of the cover main body 3 that corresponds to the cylinder head 44. Thus, even if upward reaction force acts on the valve case 4 from the cam cap 54 when installing the cylinder head 44, the reaction force acts to press the contacting portion 10 against the resin cylinder head cover main body 3. That is, for example, unlike the configuration in which the contacting portion 10 is fixed to the upper surface of the resin cylinder head cover main body 3, the reaction force does not act in the direction separating the contacting portion 10 from the main body 3, but in the direction pressing the contacting portion 10 against the main body 3. Since stress produced in the valve case 4 and the main body 3 due to the reaction force is dispersed over the entire valve case 4 and the main body 3, the valve case 4 and the main body 3 are prevented from being deformed by the reaction force.

Therefore, the valve case 4 is pressed against and reliably supported by the resin cylinder head cover main body 3 with reduced deformation. This improves the reliability of the installation. Thus, the valve case 4 is reliably installed to the cylinder head cover 2.

(2) The reaction force is produced when the lower surface 50*a* of the oil passage coupling portion 50, in which the openings 46*a*, 48*a* of the intermediate passages 46, 48 are formed, is pressed against the upper surface 54*e* of the cam cap 54, in which an opening 54*c* of the cam cap passage 54*a* and an opening 54*d* of the cam cap passage 54*b* are formed. Therefore, by securing the cylinder head cover main body 3, to which the valve case 4 is attached, to the cylinder head 44, the passage openings 46*a*, 48*a* of the valve case 4 are connected to the passage openings 54*c*, 54*d* of the cam cap 54. Further, since the lower surface 50*a* of the valve case 4 and the upper surface 54*e* of the cam cap 54 are pressed against each other, the sealing at the joint of the passages is improved. The contacting portion 10 and the oil passage coupling portion 50 function as a held portion that is held between the cylinder head 44 and the cylinder head cover main body 3.

(3) Since the contacting portion 10 is formed by the flange provided at the outer circumference of the calve case 4, the contacting area of the valve case 4 and the resin cylinder head cover main body 3 at the contacting portion 10 is increased without significantly increasing the weight of the valve case 4, and the increased contacting area facilitates the assembly that involves contacting of components.

(4) Since the cylinder head cover main body 3 and the valve case 4 are made of resin, the cylinder head cover 2 is relatively light, easy to mold, and capable of reducing noise caused by vibration.

Further, since resin is used, the resin cylinder head cover main body 3 and the valve case 4 are secured to each other by an easy process such as welding. Since the cylinder head cover main body 3 and the valve case 4 are secured to each other in advance, the assembled cover main body 3 and the valve case 4 are easily assembled with the cylinder head 44.

(5) According to the present embodiment, the contacting portion 10 of the valve case 4 contacts and is secured to the lower surface 3*b* of the resin cylinder head cover main body 3. Such welded portions hardly receive pulling force (separating force) that acts to separate these portions. As a result, unlike a conventional configuration in which the contacting portion 10 is, for example, secured to the upper surface of the resin cylinder head cover main body 3, the welded portions are prevented from separating without any auxiliary components for securing such as bolts. Even if the welding (securing) is performed in a part of the contacting portions of the valve case 4 and the resin cylinder head cover main body 3, the stress produced by the fact that these components are pressed against each other is dispersed not only to the welded portions but also to the entire contacting portions. Therefore, the valve case 4 and the cover main body 3 are prevented from being deformed.

(6) The sleeve 14 is formed in the valve case 4. In other words, a reinforcing member made of a material (aluminum alloy) having a rigidity higher than the resin forming the case 4 is provided about the mounting bore 16. Therefore, even if deformation in the part of the resin main body 3 is slightly transmitted to the valve case 4, the shape of the mounting bore 16 is hardly affected since it is surrounded by the rigid reinforcing member.

(7) The sleeve 14 is secured to the resin surface of the interior of the valve case 4 through the insert molding. The valve case 4 is fixed to the cylinder head cover main body 3 after the sleeve 14 is adhered to the resin surface with the primer. Thus, for example, compared to the configuration in which the valve case 4 is attached to the resin cylinder head cover main body 3 before fixing the sleeve 14 to the inner resin surface of the valve case 4, the components are easily handled when securing the sleeve 14, and the sleeve 14 is reliably secured by adhesion.

(8) Further, in the present embodiment, the valve case 4 is attached to the head cover main body 3 at a position directly above the one of the cam caps 54 that is closest to the variable valve actuation mechanism 30. Such arrangement of the valve case 4 permits the OCV 6 to supply and drain oil to and from the variable valve actuation mechanism 30 through extremely short oil passages. This improves the control response of the variable valve actuation mechanism 30.

It should be apparent to those skilled in the art that the present invention may be embodied in many other specific forms without departing from the spirit or scope of the invention. Particularly, it should be understood that the invention may be embodied in the following forms.

In the above embodiment, the passage openings 46*a*, 48*a*, 54*c*, 54*d* are formed in the lower surface 50*a* of the valve case 4 and the upper surface 54*e* of the cam cap 54 contacting the lower surface 50*a*. However, the openings 46*a*, 48*a*, 54*c*, 54*d* may be omitted. That is, the present invention may be applied to a configuration in which no passage openings are formed in the contacting portions of a member of the cylinder head 44 and the valve case 4.

In the above embodiment, the valve case 4 is located substantially directly above one of the cam caps 54 that is closest to the variable valve actuation mechanism 30. However, the valve case 4 may be located substantially directly above another cam cap 54. Alternatively, the valve case 4 may be located in a position that is not substantially directly above any of the cam caps 54. The member of the cylinder head 44 that contacts the valve case 4 does not need to be the cam cap 54.

In the above embodiment, the valve case 4 is fixed to the resin cylinder head cover main body 3 by welding. However, the valve case 4 may be fixed to the cover main body 3 by adhesive. Alternative, the valve case 4 may be fixed to the main body 3 by rivets or screws. When using screws to fix the valve case 4 to the main body 3, internal threads may be formed in one of the valve case 4 and the main body 3, and sheet metal screws may be used. Alternatively, screws and nuts may be used. In a case where the resin cylinder head cover main body 3 and the valve case 4 are formed of metal, these components may be fixed to each other by swaging.

In the above embodiment, the valve case 4 is fixed to the cylinder head cover main body 3 by welding, adhering, or threading. However, the valve case 4 does not need to be fixed to the main body 3 in these manners. For example, the valve case 4 may be held between a member of the cylinder head 44 such as the cam cap 54 and the resin cylinder head cover main body 3. In this case, it is preferable that projections are formed in one of the head cover main body 3 and the valve case 4, and engaging recesses corresponding to the projections are formed in the other one of the head cover main body 3 and the valve case 4, so that the valve case 4 is not laterally displaced (for example, a direction along the upper surface 54*e*) with respect to the cylinder head 44.

In the valve case 4, the contacting portion 10 that contacts the cylinder head cover main body 3 does not need to be formed on the entire circumference of the valve case 4. Also, the contacting portion 10 does not need to be formed like a flange.

In the above embodiment, the sleeve 14 is provided on the inner resin surface of the valve case 4. However, the valve case 4 may be, for example, embedded in the resin.

The sleeve 14 may be fixed to the resin portion of the valve case 4 by a method other than insert molding. For example, after the resin portion is formed, the sleeve 14 may be fixed to the resin portion with adhesive. Alternatively, the sleeve 14 may be press fitted to the attaching portion 12 of the valve case 4 without using adhesive. Further, an external thread may be formed on the outer circumferential surface of the sleeve 14, and the sleeve 14 may be screwed to the attaching portion 12 of the valve case 4.

In the above embodiment, the valve case 4, to which the sleeve 14 is fixed, is attached to the resin cylinder head cover main body 3. However, for example, the valve case 4 may be attached (for example, fixed) to the cylinder head cover main body 3 before the sleeve 14 is fixed to the valve case 4, and the sleeve 14 may then be fixed to the valve case 4.

In the above embodiment, the sleeve 14 serving as a reinforcing member is provided in the valve case 4. However, if the valve case 4 has a sufficient strength, no reinforcing member is required.

The cylinder head cover main body and the valve case 4 do not need to be formed of resin, but may be other materials such as aluminum, an aluminum alloy, and iron.

The invention claimed is:

1. A cylinder head cover for covering a cylinder head of an internal combustion engine, the engine having a variable valve actuation mechanism and a control valve for controlling supply and drainage of hydraulic oil to and from the variable valve actuation mechanism, the cylinder head cover comprising:

a cover main body fixed to the cylinder head; and a valve case to which the control valve is attached, wherein the valve case is caused to contact a side of the cover main body that faces the cylinder head, wherein the cover main body has a through hole;

the valve case includes a held portion and a valve attaching portion to which the control valve is attached, the valve attaching portion being inserted into the through hole, and with the valve case inserted into the through hole, the held portion is held between the cylinder head and cover main body.

2. The cylinder head cover according to claim 1, wherein the held portion includes:

an oil passage forming portion that forms an oil passage through which the hydraulic oil flows; and a flange provided at the oil passage forming portion, wherein the flange contacts a section of the cover main body about the through hole.

3. The cylinder head cover according to claim 1, wherein the variable valve actuation mechanism includes a cam cap and the valve case includes:

a contacting surface, wherein, with the cover main body fixed to the cylinder head, the contacting surface is pressed against and contacts the cam cap of the variable valve actuation mechanism; and an oil passage through which hydraulic oil flows, wherein the oil passage has an opening located in the contacting surface.

4. The cylinder head cover according to claim 1, wherein the valve case is fixed to the cover main body.

5. The cylinder head cover according to claim 4, wherein the valve case and the cover main body are both formed of resin, and the valve case is welded to the cover main body.

6. The cylinder head cover according to claim 1, wherein the valve case has an accommodation recess for accommodating the control valve and, the valve case further has a reinforcing member located on a circumferential surface of the accommodation recess.

7. The cylinder head cover according to claim 6, wherein the valve case is formed of resin, and wherein the reinforcing member is formed of material that has a rigidity higher than that of the resin of the valve case.

8. The cylinder head cover according to claim 1, wherein the engine includes a camshaft and a plurality of cam caps covering the camshaft, and the valve case is caused to contact the cover main body at a position directly above a cam cap that is closest to the variable valve actuation mechanism.

9. A cylinder head cover for covering a cylinder head of an internal combustion engine, the engine having a variable valve actuation mechanism and a control valve for controlling supply and drainage of hydraulic oil to and from the variable valve actuation mechanism, the cylinder head cover comprising:

a cover main body fixed to the cylinder head; and a valve case to which the control valve is attached, wherein the valve case is caused to contact a side of the cover main body that faces the cylinder head, wherein the valve case has a flange that protrudes outward, and wherein, with the cover main body fixed to the cylinder head, the flange is caused to contact the cover main body.

10. A method for mounting a cylinder head cover to a cylinder head, the cylinder head cover covering the cylinder head of an internal combustion engine having a variable valve actuation mechanism, wherein the cylinder head cover has a cover main body having a through hole and a valve case, the valve case has a valve attaching portion and a held portion, the method comprising:

inserting the valve attaching portion into the through hole;

fixing the cover main body to the cylinder head such that the held portion is held between the cover main body and the cylinder head; and attaching a control valve to the valve attaching portion, the control valve controlling supply and drainage of hydraulic oil to and from the variable valve actuation mechanism.

11. The method according to claim 10, wherein the valve attaching portion has an accommodation recess for accommodating the control valve, the method further comprising:

arranging a reinforcing member on a circumferential surface of the accommodation recess; and attaching the valve case, in which the reinforcing member is arranged, to the cover main body before inserting the valve attaching portion into the through hole.

12. The method according to claim 11, wherein the reinforcing member is attached to the valve case.

* * * * *